US009564140B2

(12) United States Patent
Shechtman et al.

(10) Patent No.: US 9,564,140 B2
(45) Date of Patent: Feb. 7, 2017

(54) SYSTEMS AND METHODS FOR ENCODING AUDIO SIGNALS

(71) Applicant: Nuance Communications, Inc., Burlington, MA (US)

(72) Inventors: Slava Shechtman, Haifa (IL); Alexander Sorin, Haifa (IL)

(73) Assignee: Nuance Communications, Inc., Burlington, MA (US)

( * ) Notice: Subject to any disclaimer, the term of this patent is extended or adjusted under 35 U.S.C. 154(b) by 93 days.

(21) Appl. No.: 14/680,360

(22) Filed: Apr. 7, 2015

(65) Prior Publication Data

US 2016/0300580 A1 Oct. 13, 2016

(51) Int. Cl.
*G10L 19/00* (2013.01)
*G10L 19/02* (2013.01)

(52) U.S. Cl.
CPC ..... *G10L 19/02* (2013.01)

(58) Field of Classification Search
CPC ..... G10L 19/002; G10L 19/012; G10L 19/22; H04N 9/7921; H04N 9/8042
USPC ..... 704/500, 206, 258, 203, 207, 260, 264, 704/E13.001, E13.007, E19.036
See application file for complete search history.

(56) References Cited

U.S. PATENT DOCUMENTS 6,463,405 B1 * 10/2002 Case ..... G10H 1/0041 704/206
9,368,103 B2 * 6/2016 Nakano ..... G10L 13/02
2009/0144053 A1 * 6/2009 Tamura ..... G10L 13/06 704/207

OTHER PUBLICATIONS

Agiomyrgiannakis and Stylianou, Stochastic Modeling and Quantization of Harmonic Phases in Speech Using Wrapped Gaussian Mixture Models, IEEE International Conference on Acoustics, Speech and Signal Processing, ICASSP, Apr. 2007, 1121-4, Honolulu, HI.

Chazan, et al., High Quality Sinusoidal Modeling of Wideband Speech or the Purposes of Speech Synthesis and Modification, IEEE International Conference on Acoustics, Speech and Signal Processing, ICASSP, May 2006, 877-80, Toulouse, France.

Eriksson, et al., Quantization of the Spectral Envelope for Sinusoidal Coders, IEEE International Conference on Acoustics, Speech and Signal Processing, ICASSP, May 1998, 37-40, Seattle, WA.

Lindblom, A Sinusoidal Voice Over Packet Coder Tailored for the Frame-Erasure Channel, IEEE Transactions on Speech and Audio Processing, Sep. 2005, 787-98, 13(5).

(Continued)

*Primary Examiner* — Charlotte M Baker
(74) *Attorney, Agent, or Firm* — Wolf, Greenfield & Sacks, P.C.

(57) ABSTRACT

Some embodiments relate to techniques for encoding an audio signal represented by a plurality of frames including a first frame. The techniques include using at least one computer hardware processor to perform: obtaining an initial discrete spectral representation of the first frame; obtaining a primary discrete spectral representation of the initial discrete spectral representation at least in part by estimating a phase envelope of the initial discrete spectral representation and evaluating the estimated phase envelope at a discrete set of frequencies; calculating a residual discrete spectral representation of the initial discrete spectral representation based on the initial discrete spectral representation and the primary discrete spectral representation; and encoding the residual discrete spectral representation using a plurality of codewords.

20 Claims, 7 Drawing Sheets

(56) References Cited

OTHER PUBLICATIONS

Schechtman and Sorin, Sinusoidal model parameterization for HMM-based TTS system, Interspeech, 11$^{th}$ Annual Conference of the International Speech Communication Association, Sep. 2010, 805-8, Chiba, Japan.

Sorin, et al., Uniform Speech Parameterization for Multi-form Segment Synthesis, Interspeech, 12$^{th}$ Annual Conference of the International Speech Communication Association, Aug. 2011, 344-7, Florence, Italy.

[No Author Listed] "SVOPC." Wikipedia. Available at http://en.wikipedia.org/wiki/SVOPC. Last accessed Nov. 25, 2014. 2 pages.

* cited by examiner

SYSTEMS AND METHODS FOR ENCODING AUDIO SIGNALS

BACKGROUND

Many speech and audio processing applications (e.g., speech analysis, speech synthesis, speech compression, speech transformation, speech coding, speech recognition, audio analysis, audio synthesis, audio compression, audio transformation, audio coding, etc.) involve approximating portions of speech and audio signals using parametric models and encoding at least some of the parameters of these models. For example, many speech and audio processing applications involve approximating portions of a signal using a sinusoidal model, whereby a windowed portion of the signal may be approximated using a finite sum of sinusoids, and encoding at least some of the parameters of the sinusoidal model. The parameters of a sinusoidal model may include an amplitude, frequency, and phase for each sinusoid in the sum of sinusoids.

SUMMARY

Some aspects of the technology described herein relate to a method for encoding an audio signal represented by a plurality of frames including a first frame. The method comprises using at least one computer hardware processor to perform: obtaining an initial discrete spectral representation of the first frame; obtaining a primary discrete spectral representation of the initial discrete spectral representation at least in part by estimating a phase envelope of the initial discrete spectral representation and evaluating the estimated phase envelope at a discrete set of frequencies; calculating a residual discrete spectral representation of the initial discrete spectral representation based on the initial discrete spectral representation and the primary discrete spectral representation; and encoding the residual discrete spectral representation using a plurality of codewords.

Some aspects of the technology described herein relate to a system for encoding an audio signal represented by a plurality of frames including a first frame. The system comprises at least one non-transitory memory storing a plurality of codewords; and at least one computer hardware processor configured to perform: obtaining an initial discrete spectral representation of the first frame; obtaining a primary discrete spectral representation of the initial discrete spectral representation at least in part by estimating a phase envelope of the initial discrete spectral representation and evaluating the estimated phase envelope at a discrete set of frequencies; calculating a residual discrete spectral representation of the initial discrete spectral representation based on the initial discrete spectral representation and the primary discrete spectral representation; and encoding the residual discrete spectral representation using a plurality of codewords.

Some aspects of the technology described herein relate to at least one non-transitory computer-readable storage medium storing processor executable instructions that, when executed by at least one computer hardware processor, cause the at least one computer hardware processor to perform a method for encoding an audio signal represented by a plurality of frames including a first frame. The method comprises: obtaining an initial discrete spectral representation of the first frame; obtaining a primary discrete spectral representation of the initial discrete spectral representation at least in part by estimating a phase envelope of the initial discrete spectral representation and evaluating the estimated phase envelope at a discrete set of frequencies; calculating a residual discrete spectral representation of the initial discrete spectral representation based on the initial discrete spectral representation and the primary discrete spectral representation; and encoding the residual discrete spectral representation using a plurality of codewords.

The foregoing is a non-limiting summary of the invention, which is defined by the attached claims.

BRIEF DESCRIPTION OF DRAWINGS

Various aspects and embodiments of the application will be described with reference to the following figures. The figures are not necessarily drawn to scale. Items appearing in multiple figures are indicated by the same or a similar reference number in all the figures in which they appear.

DETAILED DESCRIPTION

Figure 1:
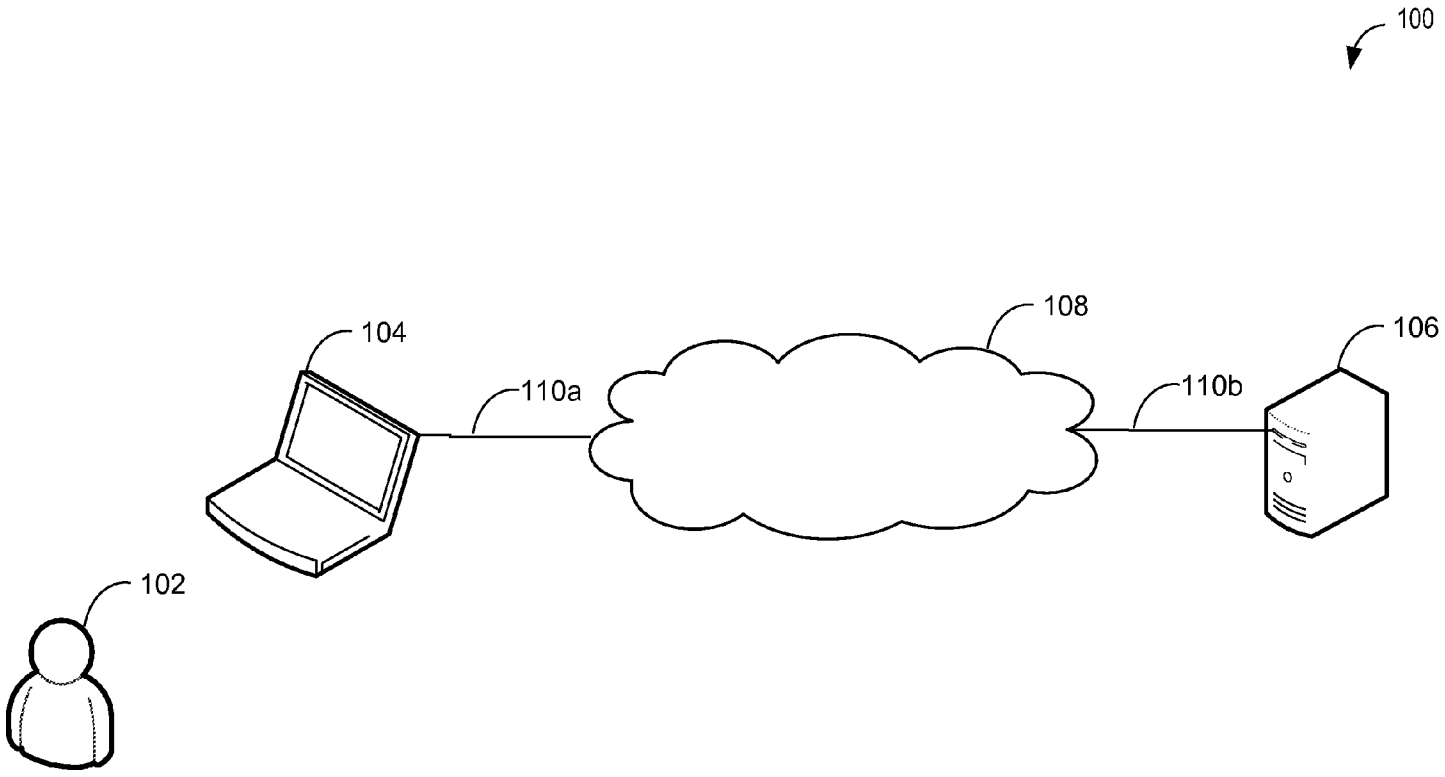
FIG. 1 shows an illustrative environment in which some embodiments of the technology described herein may operate.

The inventors have appreciated that conventional techniques for encoding parameters of a sinusoidal model may be improved upon. As described above, parameters of a sinusoidal model include amplitudes, frequencies, and phases of the sinusoids in the model. However, conventional encoding techniques do not provide for an efficient means of encoding phases of the sinusoids in the sinusoidal model. Existing approaches for encoding sinusoidal model phases require a high bit budget and have high computational complexity such that they are not suitable for implementation using fixed-point arithmetic. Accordingly, some embodiments provide for efficient techniques for encoding sinusoidal model phases and, optionally, other sinusoidal model parameters. The encoding techniques describe herein allow for encoding the sinusoidal model parameters using fewer bits than conventional encoding techniques and may be implemented in a computationally efficient manner using floating point and fixed point arithmetic.

Some embodiments of the technology described herein address one or more drawbacks of conventional techniques for encoding sinusoidal model parameters. Some embodiments provide for encoding of one or more audio frames representing an audio signal, which may be a speech signal, a music signal, and/or any other suitable type of audio signal. An audio frame representing the audio signal may be encoded by obtaining an initial discrete spectral representation (DSR) of the audio frame and encoding the initial DSR in two stages by obtaining a coarse approximation of initial DSR, including its phase envelope, and representing the information in the initial DSR, not captured by the coarse approximation, by a linear combination of codewords.

In some embodiments, the initial discrete spectral representation of a frame may comprise an amplitude and a phase for each frequency in a discrete set of frequencies. The initial discrete spectral representation may be obtained by fitting a sinusoidal model to the audio frame and/or in any other suitable way. As such, in some embodiments, encoding the initial discrete spectral representation may comprise encoding parameters of a sinusoidal model including the phase parameters of the sinusoidal model.

In some embodiments, encoding the initial discrete spectral representation may comprise: (1) obtaining a primary discrete spectral representation of initial DSR at least in part by estimating a phase envelope of the initial DSR and evaluating the estimated phase envelope at a discrete set of frequencies; (2) calculating a residual discrete spectral representation of the initial DSR based on the difference between the initial and primary discrete spectral representations; and (3) encoding the residual discrete spectral representation using a linear combination of codewords.

In some embodiments, estimating the phase envelope of the initial DSR may comprise estimating parameters of a continuous-in-frequency representation of the phase envelope. The continuous-in-frequency representation of the phase envelope may be a Mel-frequency cepstral representation such that estimating parameters of the representation may comprise estimating a plurality of Mel-frequency cepstral coefficients, for example, Mel-frequency regularized cepstral coefficients.

In some embodiments, encoding the residual discrete spectral representation using a linear combination of codewords may comprise iteratively selecting the codewords in the linear combination from one or more codebooks. The iterative selection may be performed by using a perceptual measure and/or any other suitable type of measure. The codebook(s) from which the codewords are selected may comprise stochastic codewords. For example, in some embodiments, the codebook(s) may comprise a plurality of sub-frame sub-band codewords, as described in more detail below.

It should be appreciated that the embodiments described herein may be implemented in any of numerous ways. Examples of specific implementations are provided below for illustrative purposes only. It should be appreciated that these embodiments and the features/capabilities provided may be used individually, all together, or in any combination of two or more, as aspects of the technology described herein are not limited in this respect.

FIG. 1 illustrates one illustrative environment 100 in which some embodiments of the technology described herein may operate. A user 102, in environment 100, may provide speech input to a computing device 104 (e.g., by speaking into a microphone or in any other suitable way). Software executing on the computing device, such as an application program and/or the operating system, may process the speech signal by: (1) generating speech frames representing the speech signal; (2) encoding one or more of the speech frames to obtain parameters representing the encoded frame(s); and (3) transmit the parameters, via network 108 and communication links 110*a* and 110*b*, to remote computing device 110. Remote computing device receive the transmitted parameters and use the received parameters to perform speech synthesis, speech recognition, and/or for any other suitable application.

Each of computing devices 104 and 110 may be a portable computing device (e.g., a laptop, a smart phone, a PDA, a tablet device, etc.), a fixed computing device (e.g., a desktop, a server, a rack-mounted computing device) and/or any other suitable computing device that may be configured to encode one or more frames representing an audio signal (e.g., a speech signal) in accordance with embodiments described herein. Network 108 may be a local area network, a wide area network, a corporate Intranet, the Internet, any/or any other suitable type of network. Each of connections 110*a* and 110*b* may be a wired connection, a wireless connection, or a combination thereof.

It should be appreciated that aspects of the technology described herein are not limited to operating in the illustrative environment 100 shown in FIG. 1. For example, aspects of the technology described herein may be used as part of any environment in which speech analysis, speech synthesis, speech compression, speech transformation, speech coding, speech recognition, audio analysis, audio synthesis, audio compression, audio transformation, audio coding, and/or any other suitable speech and/or audio application may be performed.

Figure 2:
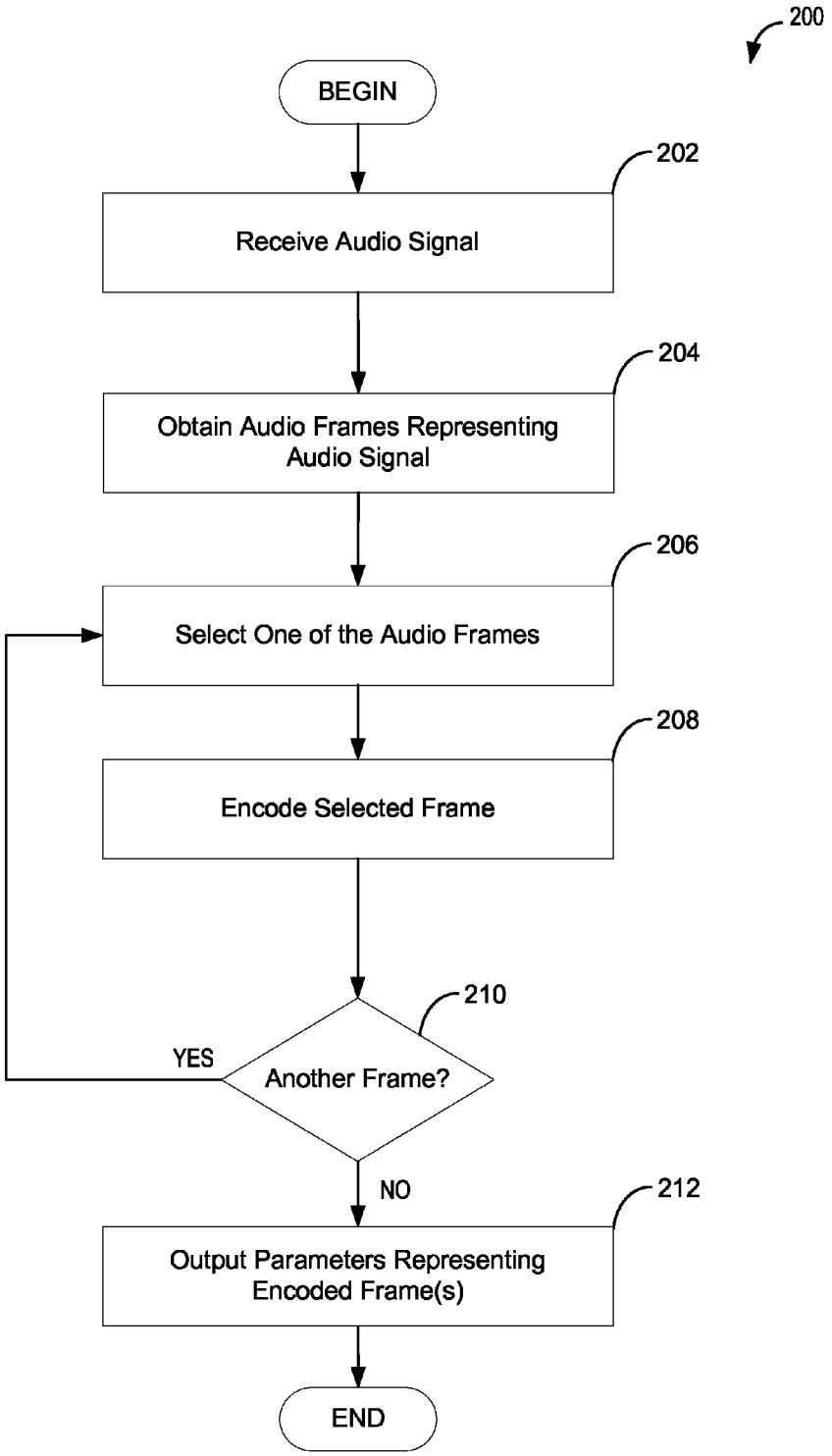
FIG. 2 is a flowchart of an illustrative process for encoding an audio signal, in accordance with some embodiments of the technology described herein.

FIG. 2 is a flowchart of an illustrative process 200 for encoding an audio signal, in accordance with some embodiments of the technology described herein. Process 200 may be performed by any suitable computing device. For example, process 200 may be performed by computing device 104 and/or server 108 described with reference to FIG. 1.

Process 200 begins at act 202, where an audio signal is obtained. The audio signal may be obtained from any suitable source. For example, the audio signal may be stored and, at act 202, accessed by a computing device performing process 200. As another example, the audio signal may be received from an application program or an operating system (e.g., from an application program or an operating system requesting that the audio signal be encoded). The audio signal may be in any suitable format, as aspects of the technology described herein are not limited in this respect.

Next, process 200 proceeds to act 204, where the audio signal received at act 202 is processed to obtain one or more audio frames representing the audio signal. Each of the obtained audio frames may represent (e.g., may comprise) a portion of the audio signal. In some instances, the audio frames may be overlapping such that two or more frames may represent a portion of the audio signal. In some instances, the audio frames may not overlap such that each frame in the plurality of frames may represent a respective portion of the audio signal. The audio frames may be generated in any suitable way and, for example, may be generated using time-shifted versions of a suitable windowing function, sometimes termed an apodization or tapering function. Examples of a windowing function that may be used include, but are not limited to a rectangular window, a triangular window, a Parzen window, a Welch window, a Hann window, a Hamming window, a Blackman window, and a raised cosine window.

Next, process 200 proceeds to act 206, where one of the audio frames is selected for encoding. The audio frame may be selected in any suitable way, as aspects of the technology described herein are not limited in this respect.

Next, process 200 proceeds to act 208, where the audio frame selected at act 206 may be encoded. In some embodiments, the audio frame may be processed to obtain an initial discrete spectral representation (DSR) of the audio frame, which representation comprises an amplitude and a phase for each frequency in a discrete set of frequencies. As such, the initial spectral representation may also be termed a "full line spectral representation." The initial DSR may be encoded in two stages: (1) obtaining a coarse approximation to the initial DSR (also called "primary discrete spectral representation" herein); and (2) obtaining a representation of the residual information in the initial DSR, which is not a captured by the coarse approximation, using a linear combination of codewords. As such, the encoding of the initial DSR may include an encoding of the coarse approximation to the initial DSR and information identifying the codewords representing the residual information not captured by the coarse approximation and the respective weights or gains of the codewords in the linear combination.

In some embodiments, obtaining the coarse representation of the initial DSR may comprise estimating a phase envelope of the initial DSR and evaluating the estimated phase envelope at a discrete set of frequencies. In some embodiments, estimating the phase envelope of the initial DSR includes estimating a continuous-in-frequency representation of the phase envelope and sampling the continuous-in-frequency representation at the discrete set of frequencies. In some embodiments, the continuous-in-frequency representation may comprise a Mel-regularized cepstral coefficient representation of the phase envelope.

In some embodiments, obtaining a representation of the residual information in the initial DSR, not captured by the coarse representation, may comprise encoding the difference between the initial DSR and the coarse representation by using a linear combination of stochastic codewords. The codewords in the linear combination may be selected iteratively from one or more codebooks. For example, codewords in the linear combination may be selected iteratively using a perceptual measure. In some embodiments, the codewords may be selected from one or more codebooks of sub-frame sub-band stochastic codewords. The above-described aspects of encoding an audio frame, at act 208 of process 200, are described further below with reference to FIG. 3.

After encoding the selected audio frame at act 208, process 200 proceeds to decision block 210, where it is determined whether another audio frame is to be encoded. This may be done in any suitable way. For example, when each of the audio frames obtained at act 204 has been encoded, it may be determined that another audio frame is not to be encoded. On the other hand, when one or more of the audio frames obtained at act 204 has not been encoded, it may be determined that another audio frame is to be encoded.

When it is determined, at decision block 210, that another audio frame is to be encoded, process 200 returns via the YES branch to act 206, and acts 206 and 208 are repeated such that another audio frame is encoded. On the other hand, when it is determined, at decision block 210, that another audio frame is not to be encoded, process 200 proceeds to act 212, where the parameters representing the encoded frames are output. The parameters may be output to one or more application programs, an operating system, stored for subsequent access, transmitted to one or more other computing devices, and/or output in any other suitable manner. After the parameters representing the encoded audio frames are output, process 200 completes.

It should be appreciated that process 200 is illustrative and that there are variations of process 200. For example, in the embodiment illustrated in FIG. 2, process 200 is applied to encoding an existing audio signal. In some embodiments, process 200 may be adapted for use in speech synthesis to encode parameters for each of a plurality of audio frames to be synthesized. In such embodiments, process 200 may be modified to not include acts 202 and 204, act 206 may be modified to select an audio frame to be synthesized, and act 208 may be modified to encode the parameters from which the selected audio frame is to be synthesized. For instance, the parameters for an audio frame to be synthesized may comprise a discrete spectral representation (e.g., a full line spectrum with an amplitude and a phase for each of a plurality of a discrete set of frequencies) and act 208 may comprise encoding the discrete spectral representation.

Figure 3:
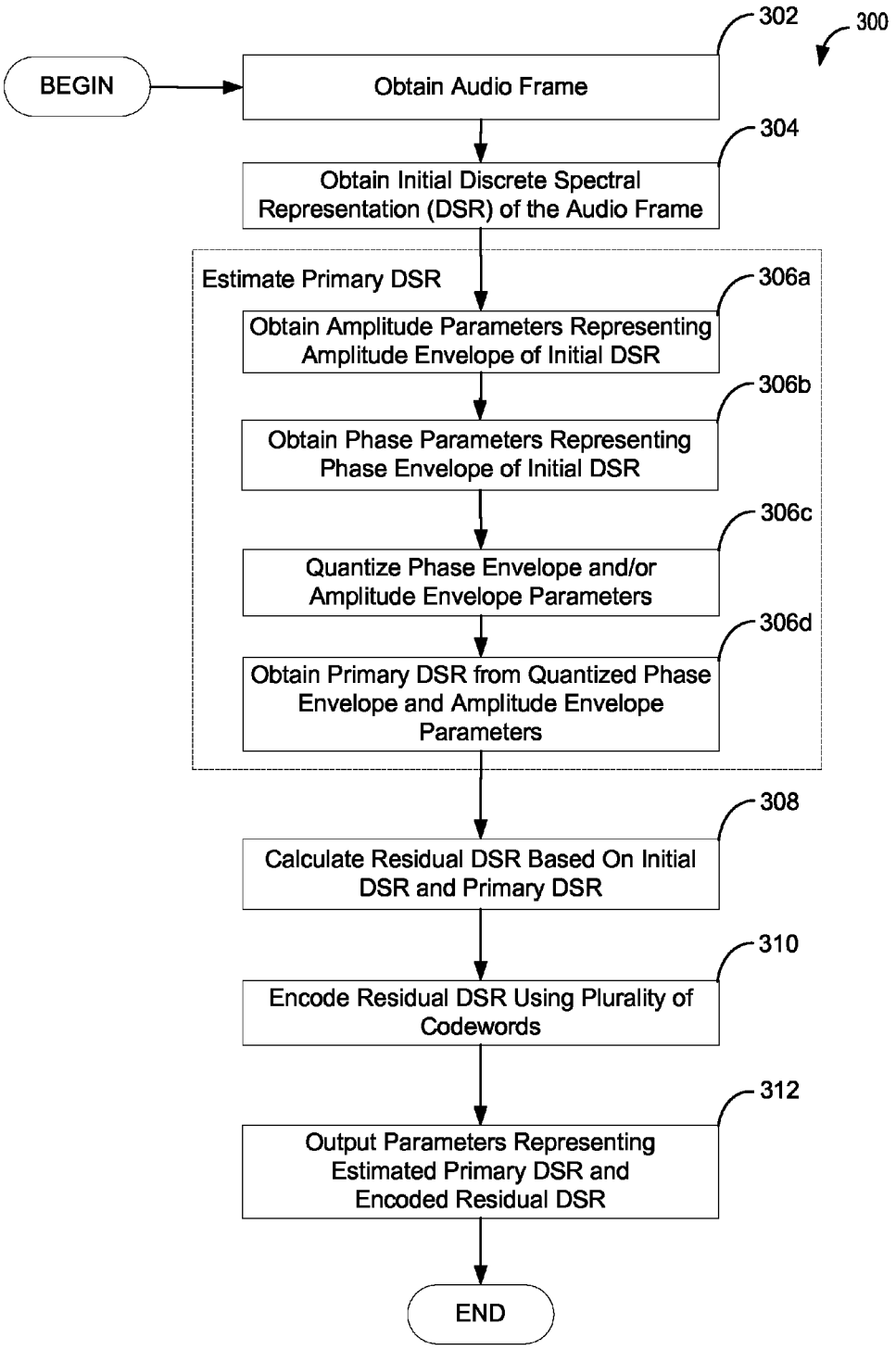
FIG. 3 is a flowchart of an illustrative process for encoding a frame of an audio signal, in accordance with some embodiments of the technology described herein.

FIG. 3 is a flowchart of an illustrative process 300 for encoding an audio frame. Process 300 may be performed by any suitable computing device. For example, process 300 may be performed by computing device 104 and/or server 108 described with reference to FIG. 1. In some embodiments, process 300 may be used to encode an audio frame as part of act 208 of process 200. In some embodiments, however, process 300 may be used independently from process 200 to encode one or more audio frames, as aspects of the technology described herein are not limited in this respect.

Process 300 begins at act 302, where an audio frame to be encoded is obtained. The audio frame may be obtained in any suitable way. For example, the audio frame may be received from an application program or an operating system. As another example, the audio frame may be obtained by processing an audio signal to obtain a set of audio frames and the audio frame may be selected from the set of audio frames. As yet another example, the audio frame may be stored and may be accessed, at act 302, by the computing device performing process 300. The audio frame may be in any suitable format, as aspects of the technology described herein are not limited in this respect.

Next, process 300 proceeds to act 304, where an initial discrete spectral representation (DSR) of the audio frame is obtained. As described above, the initial discrete spectral representation may comprise an amplitude value and a phase value for each frequency in a discrete set of frequencies. In some embodiments, the initial discrete spectral representation may be obtained by fitting a sinusoidal model to the audio frame to represent the signal in the audio frame as a finite sum of sinusoids characterized by their respective amplitudes, frequencies, and phases. The resultant initial discrete spectral representation may comprise a frequency, an amplitude, and a phase for each sinusoid in a set of sinusoids. As a specific non-limiting example, an audio frame $s_w(n)$ obtained by windowing an audio signal, may be approximated using the following sum of L+1 sinusoids:

$$s_w(n) \cong \hat{s}_w(n) = w(n)\sum_{k=0}^{L} A_k \sin(\theta_k n + \varphi_k),$$

where k is an integer ranging from 0 to L, $A_k$ is the amplitude of the kth sinusoid, $\theta_k$ is the frequency of the kth sinusoid, $\phi_k$ is the phase of the kth sinusoid, and w(n) is a windowing function examples of which have been described above. The corresponding initial discrete spectral representation then comprises the sets $\{A_k\}$, $\{\theta_k\}$, and $\{\phi_k\}$, which are the amplitudes, frequencies, and phases of the sum of sinusoids shown above in Equation (1). In embodiments in which the initial DSR is obtained by fitting a sinusoidal model to the audio frame obtained at act 302, the initial DSR may be termed a "full sinusoidal representation."

Next, process 300 proceeds to acts 306*a*, 306*b*, 306*c*, and 306*d*, where a primary discrete spectral representation of the audio frame is obtained. The primary discrete spectral representation may be a coarse approximation to the initial discrete spectral representation and any information in the initial DSR that is not captured by the primary discrete spectral representation may be encoded as described below with reference to acts 308 and 310. In the embodiment illustrated in FIG. 3, obtaining a primary discrete spectral representation of the audio frame comprises: (1) obtaining, at act 306*a*, amplitude envelope parameters representing an amplitude envelope of the initial discrete spectral representation; (2) obtaining, at act 306*b*, phase envelope parameters representing a phase envelope of the initial discrete spectral representation; (3) quantizing, at act 306*c*, the phase envelope parameters and the amplitude envelope parameters; and (4) obtaining, at act 306*d*, the primary discrete spectral representation from the quantized phase envelope parameters and the quantized amplitude envelope parameters. Each of these acts is described in more detail below.

As illustrated in FIG. 3, after performing act 304, process 300 proceeds to act 306*a*, where amplitude envelope parameters representing an amplitude envelope of the initial discrete spectral representation are obtained. In some embodiments, obtaining the amplitude envelope parameters may comprise estimating the amplitude envelope of the initial DSR and obtaining a set of amplitude envelope parameters representing the estimated amplitude envelope. Estimating the amplitude envelope of the initial DSR may comprise fitting a continuous-in-frequency representation of the amplitude envelope of the initial DSR. The continuous-in-frequency representation of the amplitude envelope may allow for calculation of an amplitude value for any frequency in a continuous range of frequencies.

The continuous-in-frequency representation of the amplitude envelope may be a linear predictive coefficient (LPC) model, a line spectral frequency (LSF) model, a Mel-frequency regularized cepstral coefficient (MRCC) model, any suitable parametric model, or any other suitable type of model. It should be appreciated that the amplitude envelope parameters may be obtained in any other suitable way, as aspects of the technology described herein are not limited in this respect. For example, in some embodiments, amplitude envelope parameters may have been previously obtained for the audio frame using any suitable technique and, at act 306*a*, the previously obtained values may be received and/or accessed.

Next, process 300 proceeds to act 306*b*, where phase envelope parameters representing a phase envelope of the initial discrete spectral representation are obtained. In some embodiments, obtaining the phase envelope parameters may comprise estimating the phase envelope of the initial DSR and obtaining a set of phase envelope parameters representing the estimated phase envelope. In some embodiments, obtaining the phase envelope parameters may be performed based, at least in part, on the amplitude envelope of the initial DSR estimated at act 306*a*.

In some embodiments, before the phase envelope of the initial DSR is estimated, the signal in the audio frame may be phase aligned. Performing the phase alignment may comprise applying a time-domain shift to the signal in the audio frame. Applying a time-domain shift may reduce entropy of the phase of the resultant signal and result in improved estimates of the phase envelope. The time-domain shift to apply to the signal in the audio frame may be determined in any suitable way. For example, the time-domain shift may be determined based on a location of an extremum (e.g., largest amplitude) of the signal. As another example, the time-domain shift may be determined so that variability of the spectral lines in a line spectrum fit to the signal is minimized. As a specific non-limiting example, in embodiments where the initial DSR is obtained by fitting a sinusoidal model such that the audio frame is approximated by a sum of sinusoids as shown in Equation (1) above, the sum of sinusoids may be shifted in the time domain by an amount t to yield the following time-shifted representation:

$$\hat{s}_w(n, \tau) = w(n)\sum_{k=0}^{L} A_k \sin(\theta_k(n-\tau) + \varphi_k),$$

In some embodiments, estimating the phase envelope of the initial DSR may comprise estimating a continuous-in-frequency representation of the phase envelope of the initial DSR. The continuous-in-frequency representation of the phase envelope may allow for calculation of a phase value for any frequency in a continuous range of frequencies. The continuous-in-frequency representation of the initial DSR's phase envelope may be a parametric representation and, for example, may be a Mel-frequency regularized cepstral coefficient (MRCC) representation (e.g., a weighted MRCC representation) as described in more detail below. However, the continuous-in-frequency representation of the phase envelope of the initial DSR may be any other suitable type of continuous-in-frequency representation, as aspects of the technology described herein are not limited in this respect.

In embodiments where the initial DSR includes phase, amplitude, and frequency parameters (e.g., when the initial DSR is obtained by fitting a sinusoidal model to the audio frame), estimating the continuous-in-frequency representation may comprise estimating parameters of the continuous-in-frequency representation based, at least in part, on the phase, amplitude, and/or frequency parameters characterizing the initial DSR. For instance, in embodiments where the continuous-in-frequency representation of the phase envelope comprises a set of Mel-frequency regularized cepstral coefficients, estimating the continuous-in-frequency representation may comprise estimate the set of Mel-frequency regularized cepstral coefficients based on the phase, amplitude, and/or frequency parameters characterizing the initial discrete spectral representation obtained at act 304. As a specific non-limiting example, the continuous-in-frequency representation may comprise an MRCC representation including a vector d of phase cepstral coefficients, which may be estimated by solving the following quadratic minimization problem:

$$d = \underset{d,\,\alpha,\,\beta}{\arg\min}\left\{\sum_{i=0}^{N}\left|\Phi(\tilde{f}_i) - \phi_i\right|^2 A_i^{\mu} + \nu\int_0^{0.5}\left[\frac{d\Phi(\tilde{f})}{d\tilde{f}}\right]^2 d\tilde{f}\right\},$$

where $\{\phi_i\}$ correspond to the unwrapped phases in the initial discrete spectral representation of the audio frame (e.g., the phases of the line spectrum components obtained by fitting a sinusoidal model to the audio frame), where $\{\tilde{f}_i\}$ and $\{A_i\}$ are Mel-frequencies and amplitudes in the initial discrete spectral representation of the audio frame (e.g., the Mel-frequencies and amplitudes of the line spectrum components obtained by fitting a sinusoidal model to the audio frame), where the continuous phase spectrum $\Phi(\tilde{f})$ is approximated in the cepstral domain as a sum of K sinusoids combined with a linear in-frequency term according to:

$$\Phi(\tilde{f}) \approx \alpha + \beta \cdot \tilde{f} - 2\Sigma_{k=1}^{K} d_k \cdot \sin(2\pi k \cdot \tilde{f}),$$

and where $\alpha$ is a constant phase offset equal to either 0 or $\pi$ depending on the polarity of the time-domain waveform, $\beta$ is a time offset of the waveform and $d=\{d_k\}$ is the vector of the phase cepstral coefficients. It should be appreciated, however, that the continuous-in-frequency representation of the phase envelope of the initial DSR may be estimated in any other suitable way, as aspects of the disclosure provided herein are not limited in this respect.

Next, process 300 proceeds to act 306*c*, where the phase envelope parameters obtained at act 306*a* and/or the amplitude envelope parameters obtained at act 306*b* may be quantized. In some embodiments, only the phase envelope parameters may be quantized. In some embodiments, only the amplitude envelope parameters may be quantized. In some embodiments, both the phase envelope parameters and the amplitude envelope parameters may be quantized. Any suitable quantization technique may be used, as aspects of the technology described herein are not limited in this respect.

Next, process 300 proceeds to act 306*d*, where the primary discrete spectral representation is obtained based on the phase envelope parameters and the amplitude envelope parameters obtained at act 306*c*. In some embodiments, the primary discrete spectral representation may comprise phase values obtained by evaluating (which may be thought of as sampling) the phase envelope, represented by the phase envelope parameters, at a set of discrete frequencies. Additionally, the primary discrete spectral representation may comprise amplitude values obtained by evaluating the amplitude envelope, represented by the amplitude envelope parameters, at a set of discrete frequencies. The phase and amplitude envelopes may be sampled at the same discrete set of frequencies. Accordingly, in some embodiments, the primary discrete spectral representation may comprise phase and amplitude values for each frequency in a discrete set of frequencies.

After the primary discrete spectral representation is obtained at acts 306*a*-306*d*, process 300 proceeds to act 308, where a residual discrete spectral representation is calculated based on the initial DSR obtained at act 304 and the primary DSR obtained at acts 306*a*-306*d*. In some embodiments, the residual DSR may be obtained by subtracting the primary DSR from the initial DSR. Though the residual DSR may be obtained in any other suitable way (e.g., weighted subtraction, frequency-dependent weighted subtraction, etc.), as aspects of the technology described herein are not limited in this respect.

Next, process 300 proceeds to act 310, where the residual discrete spectral representation obtained at act 308 is encoded using a linear combination of codewords. The codewords in the linear combination may be selected from one or more codebooks of codewords. This may be done using any suitable selection technique. In some embodiments, the codewords in the linear combination may be selected from the codebook(s) iteratively (e.g., one at a time) using one or more selection criteria. For example, the codewords in the linear combination may be selected from the codebook(s) iteratively based, at least in part, on a perceptual weighting measure. In other embodiments, codewords in the linear combination may be selected from the codebook(s) jointly rather than iteratively, using any suitable selection criteria.

In some embodiments, the codewords in the linear combination may be selected from a codebook of sub-frame sub-band stochastic codewords. The codebook may have one or more stochastic codewords for each combination of sub-frames and sub-bands. For example, the codebook may include one or more stochastic codewords for each combination of a sub-frame of M sub-frames and a sub-band of N sub-bands. Such a codebook may include one or more stochastic codewords for each combination (i, j; $1 \le i \le M$; $1 \le j \le N$) where the index i represents the ith sub-frame and the index j represents the jth sub-band.

A particular sub-frame sub-band stochastic codeword (e.g., a codeword corresponding to the ith sub-frame and jth sub-band) may be generated by: (1) generating a stochastic time-domain signal (e.g., using Gaussian noise); (2) setting portions of the stochastic time-domain signal not corresponding to a sub-frame (e.g., portions of the stochastic time-domain signal outside of the ith sub-frame) to 0 to obtain a sub-frame codeword; (3) converting the sub-frame codeword to the frequency domain (e.g., via a discrete Fourier transform) to obtain a frequency-domain sub-frame codeword; and (4) setting values of the frequency domain sub-frame codeword to zero outside of a sub-band (e.g., the jth sub-band) to obtain the particular sub-frame sub-band stochastic codeword. However, a sub-frame sub-band codeword may be generated in any other suitable way, as aspects of the technology described herein are not limited in this respect.

As a specific non-limiting example, when the audio frame received at act 302 is 5 ms long, the codebook may comprise one or more stochastic codewords for each of 1.25 ms sub-frames of the 5 ms frame and each of a multiple sub-bands. One such codeword may be generated by: (1) generating a stochastic (e.g., Gaussian) time-domain signal that is 5 ms long; (2) setting the values of the stochastic time-domain signal outside of the 0-1.25 ms portion to 0 so as to obtain a sub-frame codeword; (3) transforming the sub-frame codeword to the frequency domain to obtain a frequency-domain sub-frame codeword; and (4) setting values of the frequency domain sub-frame codeword to zero outside of a sub-band (e.g., 500-1000 Hz or any other suitable sub-band) to obtain the codeword. Another such codeword may be generated by: (1) generating a stochastic (e.g., Gaussian) time-domain signal that is 5 ms long; (2) setting the values of the stochastic time-domain signal outside of the 1.25-2.5 ms portion to 0 so as to obtain a sub-frame codeword for the second sub-frame; (3) transforming the sub-frame codeword to the frequency domain to obtain a frequency-domain sub-frame codeword; and (4) setting values of the frequency domain sub-frame codeword to zero outside of a sub-band (e.g., 500-1000 Hz or any other suitable sub-band) to obtain the codeword.

A specific non-limiting example of a technique for iteratively selecting a linear combination of K codewords $\{x_k\}$ from a codebook in the line spectral domain is described next. Let $S_0=\mathrm{diag}(A_0 \times e^{j\Phi_0})$ be diagonal matrix having its main diagonal be the primary discrete spectral representation obtained at acts 306*a*-306*d*, where $A_0$ is a vector of sinusoidal amplitudes (e.g., obtained, at act 306*d*, by evaluating the amplitude envelope of the initial DSR at a discrete set of frequencies), $\phi_0$ is a set of sinusoidal phases (e.g., obtained, at act 306*d*, by evaluating the phase envelope of the initial DSR at the discrete set of frequencies), and x is a component-wise multiplication. Let S be the initial discrete spectral representation obtained at act 304, then S may be approximated (the approximation being denote as $\hat{S}$) using $S_0$, which represents the primary discrete spectral representation, and K codewords $\{x_k\}$ according to:

$$S \approx \hat{S} = S_O(\Sigma_{k=1}^{K} \alpha_k x_k + 1),$$

where the set $\{\alpha_k\}$ is a set of weights. The overall phase approximation of the initial discrete spectral representation S is then given by $\hat{\phi}$=angle($\hat{S}$).

Given a codebook (e.g., a codebook in which each codeword represents a certain sub-frame and a certain sub-band), the codebook may be iteratively searched K times to identify the K codewords $\{x_k\}$ and the corresponding weights $\{\alpha_k\}$ to use for approximating S. During each iteration, a codeword and corresponding gain may be selected based on a perceptual measure. For example, a codeword and corresponding gain that provide the least distortion in a perceptually weighted spectral domain may be selected, as described below.

Let the partial approximation $\hat{S}_r$ of S formed by using r codewords be defined according to:

$$\hat{S}_r = S_o\left(\sum_{k=1}^{r} \alpha_k x_k + 1\right), r = 1 \ldots K.$$

The partial approximation $\hat{S}_r$ may be defined recursively by:

$$\hat{S}_O = S_O,$$

$$\hat{S}_r = \hat{S}_{r-1} + S_O \alpha_r x_r.$$

Let $\tilde{s}_r = \hat{S}_r - \hat{S}_{r-1}$ denote the partial line spectrum residual, W be a diagonal matrix representing a perceptual weighting filter, and $x_i$ be the ith codeword, then the optimal gains are given by:

$$g_{i,r} = \left(\frac{\mathrm{Re}(x_i^H S_o W^2 \tilde{s}_r)}{\mathrm{Re}(x_i^H S_o^2 W^2 x_i)}\right)$$

and the codeword indices and corresponding weights are selected according to $$\begin{cases} i_r^* = \underset{i}{\operatorname{argmax}}\, g_{i,r} \mathrm{Re}(x_i^H S_o W^2 \tilde{s}_r) \\ \alpha_r = g_{i^*,r} \end{cases}$$

Thus, at each iteration, the index of the codeword selected is given by $i_r$* and the corresponding weight of that codeword is given by $g_{i^*,x}$.

After the residual DSR is encoded at act 310, process 300 proceeds to act 312, where parameters representing the estimated primary DSR and the encoded residual DSR are output. The parameters representing the estimated primary DSR may include the amplitudes and phases obtained at act 306*d*. In embodiments where the signal in the audio frame was phase aligned by a time-domain shift τ, the parameters representing the estimated primary DSR may include the time-domain shift τ. The parameters representing the encoded residual DSR may include the indices of the codewords selected to represent the residual DSR and the corresponding weights.

The parameters representing the estimated primary DSR and the encoded residual DSR may be output in any suitable way. For example, the parameters may be provided to an application program, an operating system, transmitted to a remote computing device, stored, output in a combination of any of these ways or in any other suitable way. In some embodiments, the parameters representing the estimated primary DSR and the encoded residual DSR may be quantized prior to being output. The parameters may be quantized using a split VQ scheme or any other suitable quantization technique, as aspects of the technology described herein are not limited in this respect. After the parameters representing the estimated primary DSR and the encoded residual DSR are output, process 300 completes.

It should be appreciated that process 300 is illustrative and that there are variations of process 300. For example, process 300 may be adapted for use in the context of speech synthesis. In this variation, process 300 may be modified to not perform act 302, but to begin at act 304 in which an initial discrete spectral representation for a frame to be synthesized is received. For example, at act 304 in the modified process, a set of amplitudes and phases for each of a discrete set of frequencies may be received.

Figure 4A:
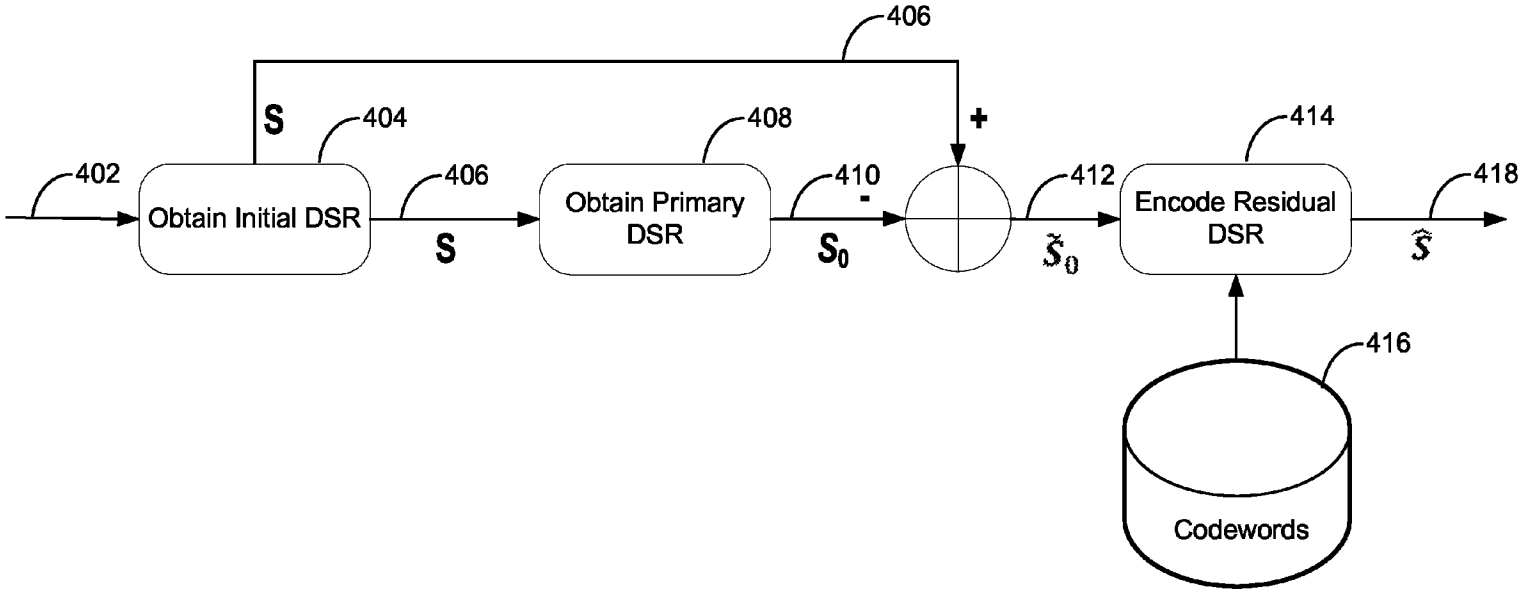
FIG. 4A is a block diagram of an illustrative technique for encoding a frame of an audio signal, in accordance with some embodiments of the technology described herein.
Figure 4B:
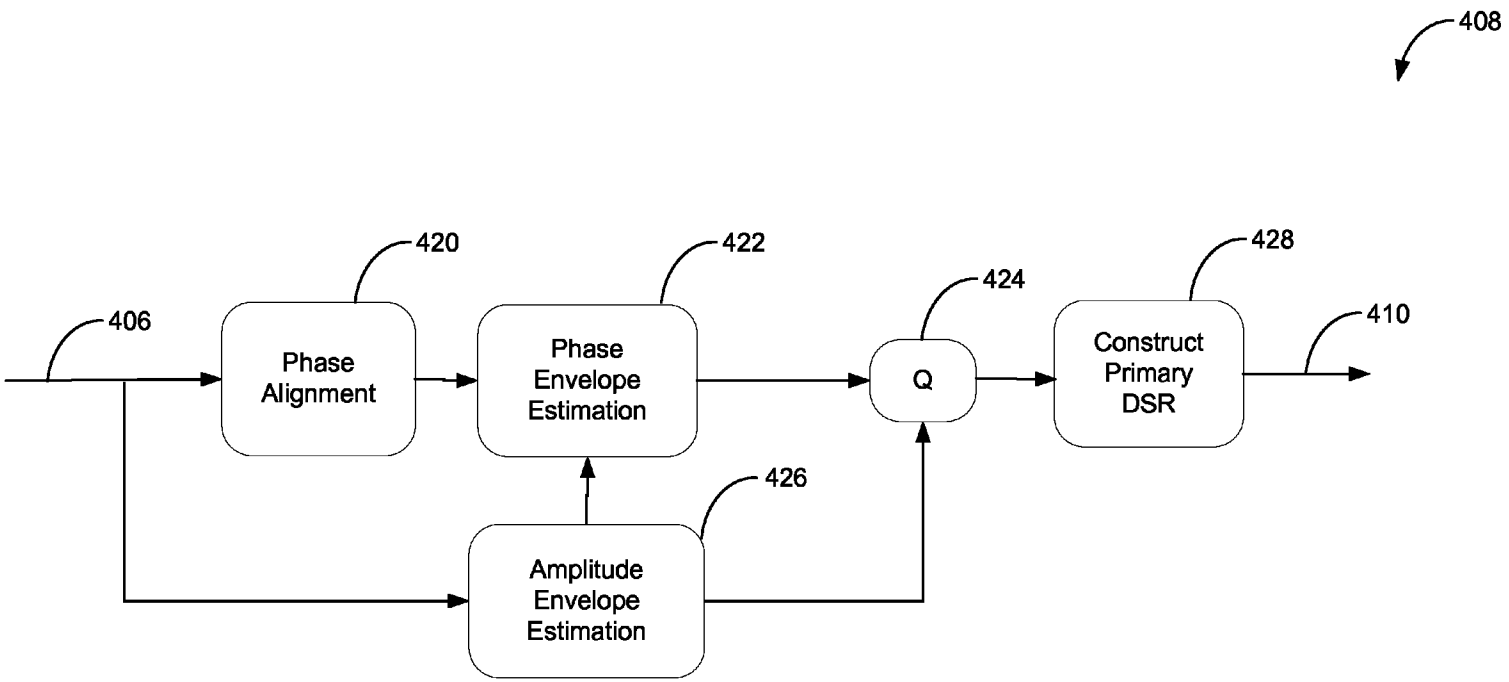
FIG. 4B is a block diagram of an illustrative technique for obtaining a primary discrete spectral representation of an audio frame, in accordance with some embodiments of the technology described herein.
Figure 4C:
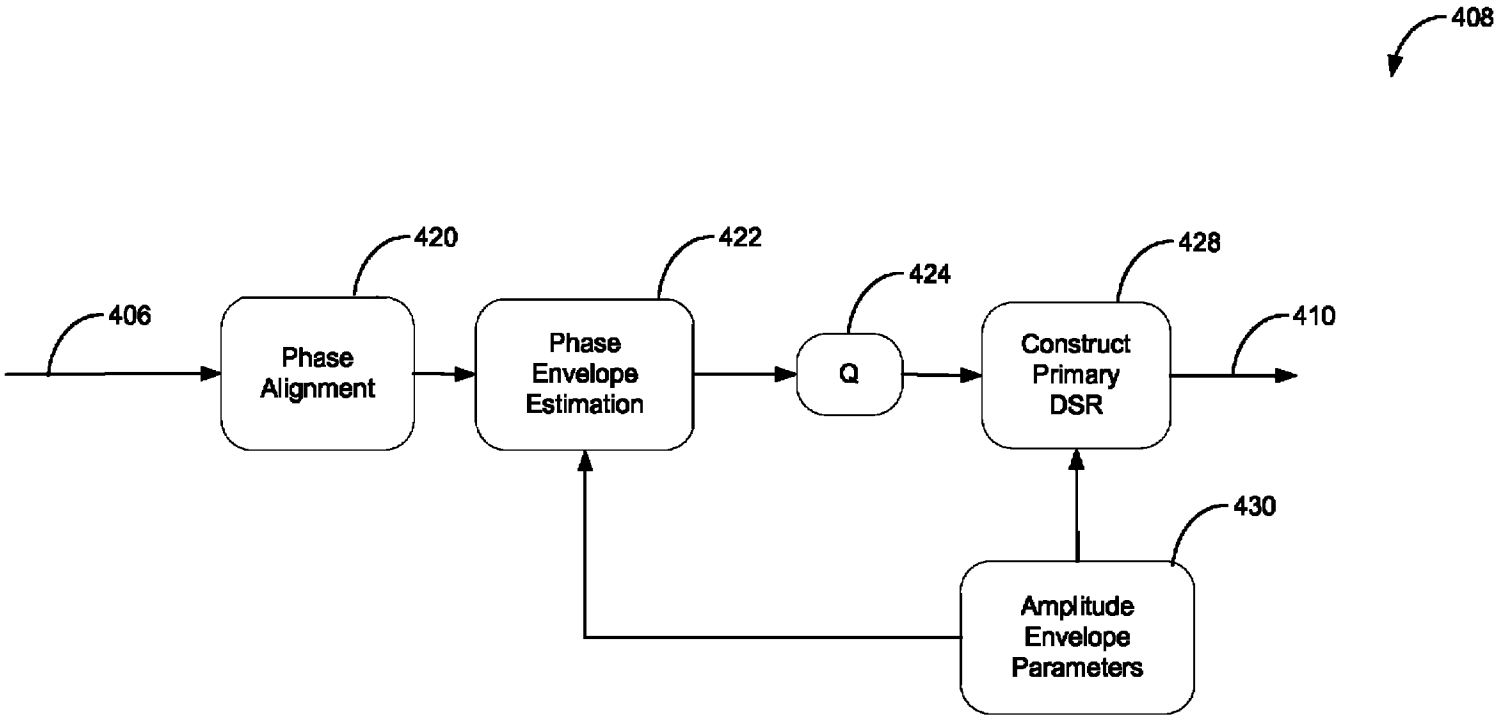
FIG. 4C is a block diagram of another illustrative technique for obtaining a primary discrete spectral representation of an audio frame, in accordance with some embodiments of the technology described herein.

Aspects of the technology described herein are further illustrated in the block diagrams shown in FIGS. 4A, 4B, and 4C. FIG. 4A is a block diagram of an illustrative technique for encoding a frame of an audio signal.

As shown in the block diagram of FIG. 4A, audio frame 402 is provided as input to block 404 in which an initial discrete spectral representation (DSR) 406, also denoted by S, is obtained for the audio frame 402. The initial DSR 406 may comprise an amplitude and a phase value for each frequency in a discrete set of frequencies and may be obtained in any of the ways described above. For example, the initial DSR 406 may be obtained by fitting a full sinusoidal model to the audio frame 402. The initial DSR 406 is provided as input to block 408 in which a primary discrete representation 410, also denoted by $S_0$, of the initial DSR is obtained. The primary DSR may be obtained in any of the ways described above, and in any of the ways described below with reference to FIGS. 4B and 4C.

As further shown in FIG. 4A, the residual DSR 412, also denoted by $\tilde{S}_0$, may be computed as a difference between the initial DSR 406 and the primary DSR 410. That is, $\tilde{S}_0$ may be obtained as the difference $S-S_0$. The residual DSR 412 may be encoded at block 414, using a linear combination of codewords in codebook 416, to obtain an approximation 418, also denoted as $\tilde{S}$, to the initial DSR. The encoding may be performed in any suitable way including the ways described above. The parameters of the approximation provide an encoding of the audio frame 402.

FIG. 4B is a block diagram of an illustrative technique for obtaining a primary discrete spectral representation of an audio frame, which technique may be performed as part of block 408 shown in FIG. 4A. As shown in FIG. 4B, the initial DSR 406 may be input to block 420, where phase alignment is performed. After phase alignment is performed, a phase envelope of the initial DSR is estimated at block 422. The phase envelope of the initial DSR may be estimated in any of the ways described above with reference to FIG. 3 or in any other suitable way. The parameters representing the estimated phase envelope (e.g., Mel-frequency regularized cepstral parameters) may be quantized at block 424 and used to construct the primary DSR at block 428. For example, the phase envelope represented by the quantized phase envelope parameters may be sampled at a set of discrete frequencies to obtain a set of phase values that form a portion of the primary DSR.

As also shown in FIG. 4B, the initial DSR 406 may be input to block 426, where an amplitude envelope of the initial DSR is estimated. The amplitude envelope may be estimated in any of the ways described above with reference to FIG. 3 or in any other suitable way. The parameters representing the estimated amplitude envelope (e.g., Mel-frequency regularized cepstral parameters) may be quantized at block 424 and used to construct the primary DSR at block 428. For example, the amplitude envelope represented by the quantized amplitude envelope parameters may be sampled at a set of discrete frequencies to obtain a set of amplitude values that form a portion of the primary DSR.

FIG. 4C is a block diagram of another illustrative technique for obtaining a primary discrete spectral representation of an audio frame, which technique may be performed as part of block 408 shown in FIG. 4A. The technique illustrated in FIG. 4C is a variant of the technique illustrated in FIG. 4B. In contrast to the technique of FIG. 4B, the technique of FIG. 4C does not include estimating the amplitude envelope of the initial discrete spectral representation 406. Rather, amplitude envelope parameters may have been previously obtained using any suitable technique and, at block 430, may be received and/or accessed.

Figure 5:
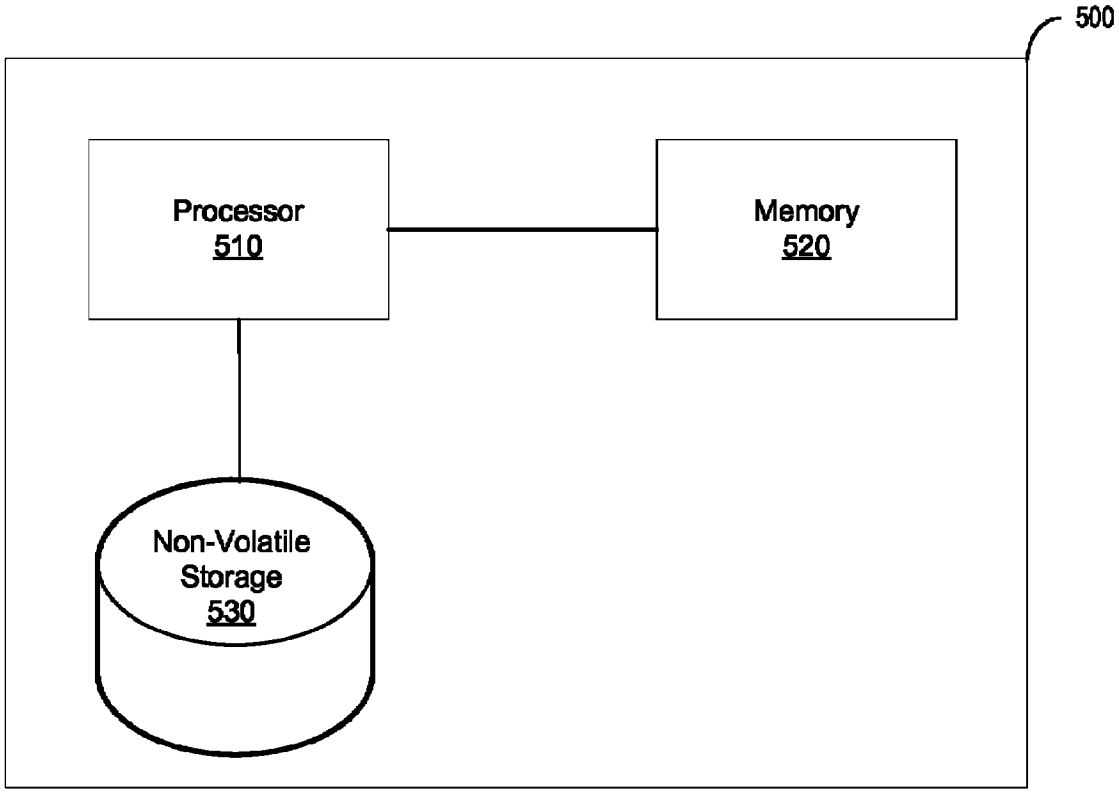
FIG. 5 is a block diagram of an illustrative computer system that may be used in implementing some embodiments.

An illustrative implementation of a computer system 500 that may be used in connection with any of the embodiments of the disclosure provided herein is shown in FIG. 5. The computer system 500 may include one or more processors 510 and one or more articles of manufacture that comprise non-transitory computer-readable storage media (e.g., memory 520 and one or more non-volatile storage media 530). The processor 510 may control writing data to and reading data from the memory 520 and the non-volatile storage device 530 in any suitable manner, as the aspects of the disclosure provided herein are not limited in this respect. To perform any of the functionality described herein, the processor 510 may execute one or more processor-executable instructions stored in one or more non-transitory computer-readable storage media (e.g., the memory 520), which may serve as non-transitory computer-readable storage media storing processor-executable instructions for execution by the processor 510.

The terms "program" or "software" are used herein in a generic sense to refer to any type of computer code or set of processor-executable instructions that can be employed to program a computer or other processor to implement various aspects of embodiments as discussed above. Additionally, it should be appreciated that according to one aspect, one or more computer programs that when executed perform methods of the disclosure provided herein need not reside on a single computer or processor, but may be distributed in a modular fashion among different computers or processors to implement various aspects of the disclosure provided herein.

Processor-executable instructions may be in many forms, such as program modules, executed by one or more computers or other devices. Generally, program modules include routines, programs, objects, components, data structures, etc. that perform particular tasks or implement particular abstract data types. Typically, the functionality of the program modules may be combined or distributed as desired in various embodiments.

Also, data structures may be stored in one or more non-transitory computer-readable storage media in any suitable form. For simplicity of illustration, data structures may be shown to have fields that are related through location in the data structure. Such relationships may likewise be achieved by assigning storage for the fields with locations in a non-transitory computer-readable medium that convey relationship between the fields. However, any suitable mechanism may be used to establish relationships among information in fields of a data structure, including through the use of pointers, tags or other mechanisms that establish relationships among data elements.

Also, various inventive concepts may be embodied as one or more processes, of which examples have been provided. The acts performed as part of each process may be ordered in any suitable way. Accordingly, embodiments may be constructed in which acts are performed in an order different than illustrated, which may include performing some acts simultaneously, even though shown as sequential acts in illustrative embodiments.

All definitions, as defined and used herein, should be understood to control over dictionary definitions, and/or ordinary meanings of the defined terms.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

Use of ordinal terms such as "first," "second," "third," etc., in the claims to modify a claim element does not by itself connote any priority, precedence, or order of one claim element over another or the temporal order in which acts of a method are performed. Such terms are used merely as labels to distinguish one claim element having a certain name from another element having a same name (but for use of the ordinal term).

The phraseology and terminology used herein is for the purpose of description and should not be regarded as limiting. The use of "including," "comprising," "having," "containing", "involving", and variations thereof, is meant to encompass the items listed thereafter and additional items.

Having described several embodiments of the techniques described herein in detail, various modifications, and improvements will readily occur to those skilled in the art. Such modifications and improvements are intended to be within the spirit and scope of the disclosure. Accordingly, the foregoing description is by way of example only, and is not intended as limiting. The techniques are limited only as defined by the following claims and the equivalents thereto.

What is claimed is:

1. A method for encoding an audio signal represented by a plurality of frames including a first frame, the method comprising:

using at least one computer hardware processor to perform:

obtaining an initial discrete spectral representation of the first frame;

obtaining a primary discrete spectral representation of the initial discrete spectral representation at least in part by estimating a phase envelope of the initial discrete spectral representation and evaluating the estimated phase envelope at a discrete set of frequencies;

calculating a residual discrete spectral representation of the initial discrete spectral representation based on the initial discrete spectral representation and the primary discrete spectral representation;

encoding the residual discrete spectral representation using a plurality of codewords to obtain an encoded residual discrete spectral representation; and outputting parameters representing the primary discrete spectral representation and the encoded residual discrete spectral representation.

2. The method of claim 1, wherein estimating the phase envelope comprises estimating parameters of a continuous-in-frequency representation of the phase envelope.

3. The method of claim 2, wherein estimating the parameters of the continuous-in -frequency representation of the phase envelope comprises estimating a plurality of Mel-frequency regularized cepstral coefficients.

4. The method of claim 1, wherein obtaining the primary discrete spectral representation further comprises estimating an amplitude envelope of the initial discrete spectral representation and evaluating the estimated amplitude envelope at the discrete set of frequencies.

5. The method of claim 1, wherein obtaining the initial discrete spectral representation of the first frame comprises fitting a sinusoidal model to the first frame.

6. The method of claim 1, wherein encoding the residual discrete spectral representation using the plurality of codewords comprises encoding the residual discrete spectral representation using a linear combination of stochastic codewords, the stochastic codewords selected from the plurality of codewords.

7. The method of claim 6, wherein a first stochastic codeword in the linear combination of stochastic codewords is obtained by:

generating a stochastic time-domain signal comprising portions corresponding to sub-frames of the first frame including a first portion corresponding to a first sub-frame of the first frame;

setting values of the stochastic time-domain signal outside of the first portion to zero to obtain a sub-frame codeword;

converting the sub-frame codeword to a frequency domain to obtain a frequency-domain sub-frame codeword; and setting values of the frequency-domain sub-frame codeword to zero outside of a sub-band to obtain the first stochastic codeword.

8. The method of claim 1, wherein encoding the residual discrete spectral representation comprises iteratively selecting codewords in the plurality of codewords based at least in part on a perceptual measure.

9. A system for encoding an audio signal represented by a plurality of frames including a first frame, the system comprising:

at least one non-transitory memory storing a plurality of codewords; and at least one computer hardware processor configured to perform:

obtaining an initial discrete spectral representation of the first frame;

obtaining a primary discrete spectral representation of the initial discrete spectral representation at least in part by estimating a phase envelope of the initial discrete spectral representation and evaluating the estimated phase envelope at a discrete set of frequencies;

calculating a residual discrete spectral representation of the initial discrete spectral representation based on the initial discrete spectral representation and the primary discrete spectral representation;

encoding the residual discrete spectral representation using a plurality of codewords to obtain an encoded residual discrete spectral representation; and outputting parameters representing the primary discrete spectral representation and the encoded residual discrete spectral representation.

10. The system of claim 9, wherein estimating the phase envelope comprises estimating parameters of a continuous-in-frequency representation of the phase envelope.

11. The system of claim 10, wherein estimating the parameters of the continuous-in -frequency representation of the phase envelope comprises estimating a plurality of Mel-frequency regularized cepstral coefficients.

12. The system of claim 9, wherein obtaining the primary discrete spectral representation further comprises estimating an amplitude envelope of the initial discrete spectral representation and evaluating the estimated amplitude envelope at the discrete set of frequencies.

13. The system of claim 9, wherein encoding the residual discrete spectral representation using the plurality of codewords comprises encoding the residual discrete spectral representation using a linear combination of stochastic codewords, the stochastic codewords selected from the plurality of codewords.

14. The system of claim 13, wherein a first stochastic codeword in the linear combination of stochastic codewords is obtained by:

generating a stochastic time-domain signal comprising portions corresponding to sub-frames of the first frame including a first portion corresponding to a first sub-frame of the first frame;

setting values of the stochastic time-domain signal outside of the first portion to zero to obtain a sub-frame codeword;

converting the sub-frame codeword to a frequency domain to obtain a frequency-domain sub-frame codeword; and setting values of the frequency-domain sub-frame codeword to zero outside of a sub-band to obtain the first stochastic codeword.

15. At least one non-transitory computer-readable storage medium storing processor executable instructions that, when executed by at least one computer hardware processor, cause the at least one computer hardware processor to perform a method for encoding an audio signal represented by a plurality of frames including a first frame, the method comprising:

obtaining an initial discrete spectral representation of the first frame;

obtaining a primary discrete spectral representation of the initial discrete spectral representation at least in part by estimating a phase envelope of the initial discrete spectral representation and evaluating the estimated phase envelope at a discrete set of frequencies;

calculating a residual discrete spectral representation of the initial discrete spectral representation based on the initial discrete spectral representation and the primary discrete spectral representation;

encoding the residual discrete spectral representation using a plurality of codewords to obtain an encoded residual discrete spectral representation; and outputting parameters representing the primary discrete spectral representation and the encoded residual discrete spectral representation.

16. The at least one non-transitory computer-readable storage medium of claim 15, wherein estimating the phase envelope comprises estimating parameters of a continuous-in -frequency representation of the phase envelope.

17. The at least one non-transitory computer-readable storage medium of claim 16, wherein estimating the parameters of the continuous-in-frequency representation of the phase envelope comprises estimating a plurality of Mel-frequency regularized cepstral coefficients.

18. The at least one non-transitory computer-readable storage medium of claim 15, wherein obtaining the primary discrete spectral representation further comprises estimating an amplitude envelope of the initial discrete spectral representation and evaluating the estimated amplitude envelope at the discrete set of frequencies.

19. The at least one non-transitory computer-readable storage medium of claim 15, wherein encoding the residual discrete spectral representation using the plurality of codewords comprises encoding the residual discrete spectral representation using a linear combination of stochastic codewords, the stochastic codewords selected from the plurality of codewords.

20. The at least one non-transitory computer-readable storage medium of claim 19, wherein a first stochastic codeword in the linear combination of stochastic codewords is obtained by:

generating a stochastic time-domain signal comprising portions corresponding to sub-frames of the first frame including a first portion corresponding to a first sub-frame of the first frame;

setting values of the stochastic time-domain signal outside of the first portion to zero to obtain a sub-frame codeword;

converting the sub-frame codeword to a frequency domain to obtain a frequency-domain sub-frame codeword; and setting values of the frequency-domain sub-frame codeword to zero outside of a sub-band to obtain the first stochastic codeword.

* * * * *